United States Patent [19]

Swanson

[11] 4,291,826

[45] Sep. 29, 1981

[54] STORAGE CONTAINER

[76] Inventor: John L. Swanson, 2100 Sargent Ave., St. Paul, Minn. 55105

[21] Appl. No.: 59,482

[22] Filed: Jul. 20, 1979

[51] Int. Cl.[3] ..... B65D 5/26

[52] U.S. Cl. ..... 229/31 FS; 229/34 R

[58] Field of Search ..... 229/31 FS, 34 R, 34 A, 229/34 B

[56] References Cited

U.S. PATENT DOCUMENTS

| | | | |
|---|---|---|---|
| 536,064 | 3/1895 | Birley | 229/34 R X |
| 1,772,106 | 8/1930 | Miller | 229/DIG. 4 |
| 1,997,523 | 4/1935 | Katz | 229/34 R |
| 2,206,304 | 7/1940 | Ringler | 229/31 FS |
| 2,373,730 | 4/1945 | Williamson et al. | 229/34 A |
| 2,753,103 | 7/1956 | Van Rosen et al. | 229/34 R |
| 3,913,823 | 10/1975 | Lin | 229/31 FS |
| 4,148,429 | 4/1979 | Burr et al. | 229/31 FS X |

FOREIGN PATENT DOCUMENTS

| | | | |
|---|---|---|---|
| 1233719 | 5/1971 | United Kingdom | 229/34 A |

*Primary Examiner*—Davis T. Moorhead

*Attorney, Agent, or Firm*—Merchant, Gould, Smith, Edell, Welter & Schmidt

[57] ABSTRACT

A container designed for assembly without separable fasteners to comprise a leakproof receptacle or tray for use by meat packers and others. The container is formed from a single blank of corrugated fibreboard having a water-repellent surface. It comprises sides (23, 24) and ends (21, 22) rising from a bottom (10) orthogonally, and interconnected by webbed corners (25, 28). The ends are provided with flaps (30, 40) including lock tabs (31, 32, 41, 42) with tongues (33, 34, 43, 44) which cooperate with the flaps to hold the corners against the outsides of the ends, and the material is crushed, at the lower corners (110) of the container and at the points of action (120) of the tongues, to provide flexibility and prevent damage to the material at sharp folds.

8 Claims, 7 Drawing Figures

Fig. 1
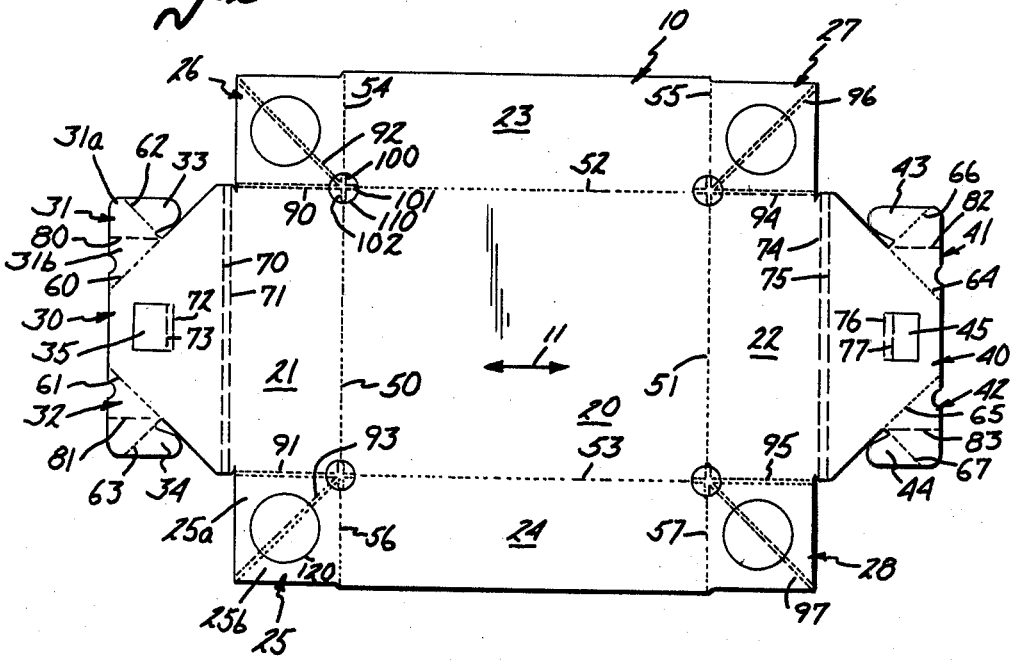
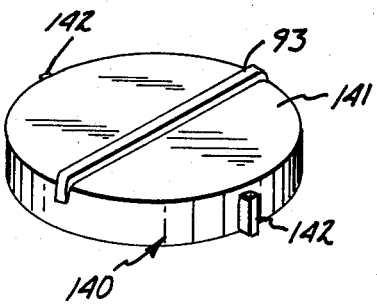
Fig. 4
Fig. 2
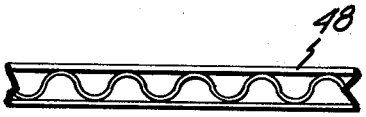
Fig. 3
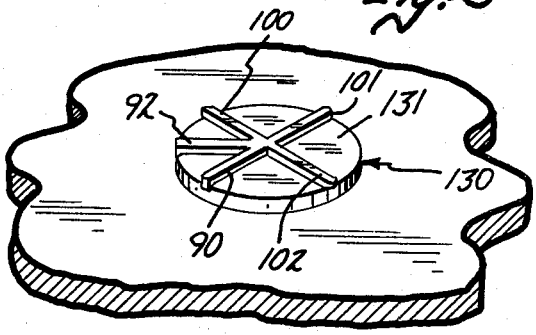

STORAGE CONTAINER

TECHNICAL FIELD

This invention relates to the field of storage containers, and particularly to containers intended for ready assembly without tools or fasteners for the storage of material in connection with which liquid may be present.

BACKGROUND OF THE PRIOR ART

In the meat packing industry there is a need for containers to receive freshly butchered meat. Such containers are often used as trays for temporary storage or transportation, but can include or be provided with covers. Corrugated cardboard is a useful and inexpensive material for this purpose. The containers must have considerable strength, to store usefully large quantities of meat. They must be inexpensive, compact before assembly for use, and easy to assemble. They should also be liquid tight to prevent leakage of fluids such as blood.

One container intended for this purpose is shown in Rennie et al. U.S. Pat. No. 3,399,819. It has the disadvantage that its use requires separate fasteners for assembly, which is not only unwelcome from the assembler's point of view, but involves staples which are not acceptable in the food industry.

BRIEF SUMMARY OF THE INVENTION

My invention comprises a container designed for assembly without separable fasteners to comprise a leakproof receptacle or tray for use by meat packers and others. My container is formed from a single blank of corrugated cardboard having a water-repellent surface. It comprises sides and ends rising from a bottom orthogonally, and interconnected by webbed corners. The ends are provided with flaps including lock tabs with tongues which cooperate with the flaps to hold the corners against the outsides of the ends, and the material is crushed, at the lower corners of the container and at the points of action of the tongues, to provide flexibility and prevent damage to the material at sharp folds.

Various advantages an features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawings,

FIG. 1 is a plan view of a blank from which my container is formed, viewed from what will be the inner surface thereof;

FIG. 2 is a schematic showing of material used for my blank;

FIGS. 3 and 4 show die inserts used in the production of my container blanks;

DETAILED DESCRIPTION OF THE INVENTION

Figure 5:
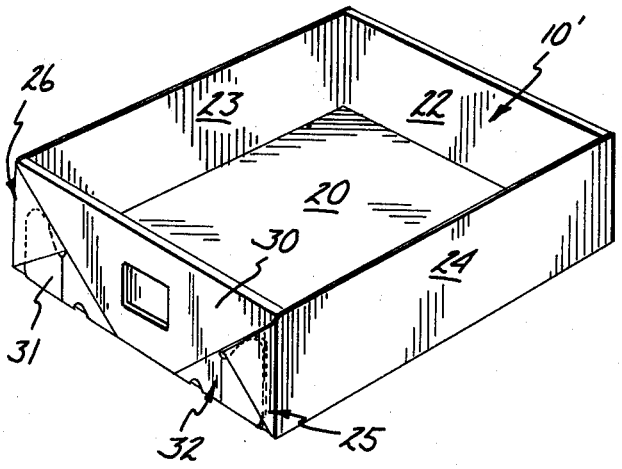
FIG. 5 shows a completed container according to my invention.

Reference should first be made to FIG. 1, which shows a blank according to my invention before folding into a container. The blank 10 is die punched from corrugated fibreboard having the corrugations running in the direction of arrow 11. It is made up of a bottom 20, ends 21 and 22, sides 23 and 24, and webbed corners 25, 26, 27 and 28. End 21 includes a flap 30 having lock tabs 31 and 32 with tongues 33 and 34 respectively, and includes a handle fold-out 35. End 22 includes a flap 40 having lock tabs 41 and 42 with tongues 43 and 44, respectively, and includes a handle fold-out 45.

As shown in FIG. 2, the material from which blank 10 is made includes an inner, water-repellent layer 48.

Folding of blank 10 into its three-dimensional configuration is facilitated by crease scores shown as dotted lines, special wider scores shown as dotted double lines, and perforated scores shown as dashed lines. Only the perforated scores pass completely through the material. Thus, crease scores 50 and 51 are between bottom 20 and ends 21 and 22, respectively, crease scores 52 and 53 are between bottom 21 and sides 23 and 24, respectively, crease scores 54 and 55 are between side 23 and ends 26 and 27, respectively, crease scores 56 and 57 are between side 24 and ends 25 and 28, respectively, crease scores 60 and 61 are between flap 30 and tabs 31 and 32, respectively, crease scores 62 and 63 are between tabs 31 and 32 and tongues 33 and 34, respectively, crease scores 64 and 65 are between flap 40 and tabs 41 and 42 respectively, and crease scores 66 and 67 are between tabs 41 and 42 and tongues 43 and 44 respectively. Double perforation scores 70 and 71 enable folding of flap 30 with respect to end 21, double perforation scores 72 and 73 enable folding of handle fold-out 35, double perforation scores 74 and 75 enable folding of flap 40 with respect to end 22, and double perforation scores 76 and 77 enable folding of handle fold-out 45. Perforation scores 80 and 81 enable folding of tabs 31 and 32 respectively, and perforation scores 82 and 83 enable folding of tabs 41 and 42 respectively: for example, score 80 lies between portions 31*a* and 31*b* of tab 31.

Special scores 90 and 91 are between end 21 and corners 25 and 26 respectively, and special scores 92 and 93 extend diagonally across corners 26 an 25 respectively. Special scores 94 and 95 are between end 22 and corners 27 and 28 respectively, and special scores 96 and 97 extend diagonally across corners 27 and 28 respectively. By way of specific illustration, special score 93 lies between portions 25*a* and 25*b* of corner 25, which are adjacent end 21 and side 24 respectively.

At the intersection of scores 50, 52 and 54 those scores are widened for short distances as shown at 100, 101 and 102, and the circle 110 indicates that an area of material is crushed, to a less extent than at the special scores, to minimize damage to the container during folding. The same arrangements are made at the other three corners of bottom 20.

The circle 120 in corner 25 indicates another area that is crushed to prevent damage during folding, and similar precautions are taken in corners 26, 27 and 28.

FIG. 3 suggests that the function desired at circle 110 of FIG. 1 may be accomplished by an insert 130 for the die cutting the blank and forming the scores. The rules for scoring the blank are shown at 100, 101, 102, 90 and 92, and the body 131 of the insert is raised above the die proper, by an amount less than that of the rules, but sufficient nevertheless to crush the material and hence overcome its stiffness and increase its flexibility.

FIG. 4 shows that the same principle can be applied to perform the function shown at circle 120, using an insert 140 having a portion of rule 93 and a raised body 141. Suitable means such as lugs 142 may be provided to prevent rotation of insert 140 in the die, and may also be provided for insert 130 of FIG. 3.

Figure 7:
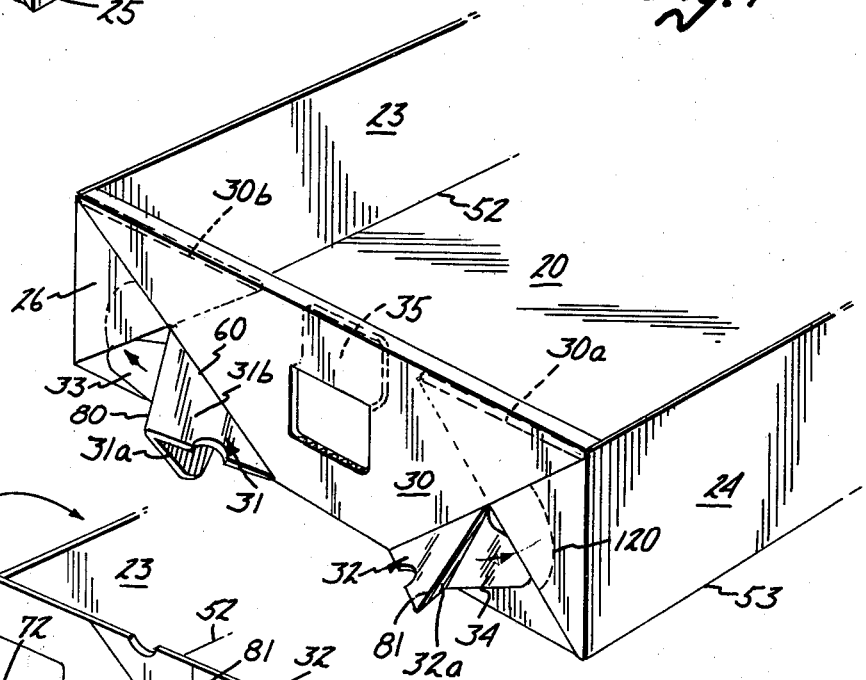
FIGS. 6 and 7 are views showing steps followed in converting the blank to the finished container.

The procedure for forming the blank 10 into a box 10' shown in FIG. 5 will now be explained, referring to FIGS. 6 and 7. The surface seen in FIG. 1 is surface 48 of FIG. 2: crease scores are provided when folds are to be made inward or upward as seen in FIG. 1, and perforation scores are provided where the folds are to be outward or downward.

Handle fold-out 35 is first pushed downward and folded twice, along scores 72 and 73, so that it lies along the undersurface of flap 30. Fold-out 45 is treated likewise.

Sides 23 and 24 are folded upward along scores 52 and 53, and end 21 is folded upward along scores 50. This causes corner 25 to fold inward along score 93 as shown in FIG. 6. The corner is then folded back against end 21—see corner 26 of FIG. 6. Here the folds along scores 90 and 92 are outward, and that along score 54 is inward. When both corners are thus folded, flap 30 is twice folded outward, to cover portions of corners 25 and 26 at 30*a* and 30*b*, FIG. 7. Tab 31 is folded so that portions 31*a* and 31*b* lie together and extend orthogonally to flap 30 and end 21: to accomplish this the folds along scores 60 and 62 are inward with respect to surface 48, and the fold along score 80 is outward. Tongue 33 now lies flat along the surface of end 21, with its tip adjacent corner 26. By pressure on tab 31, tongue 33 slides smoothly and pivotally under the portion of corner 26 where the material has been crushed, making the insertion simple and preventing undesired creasing of the material during the process.

Figure 6:
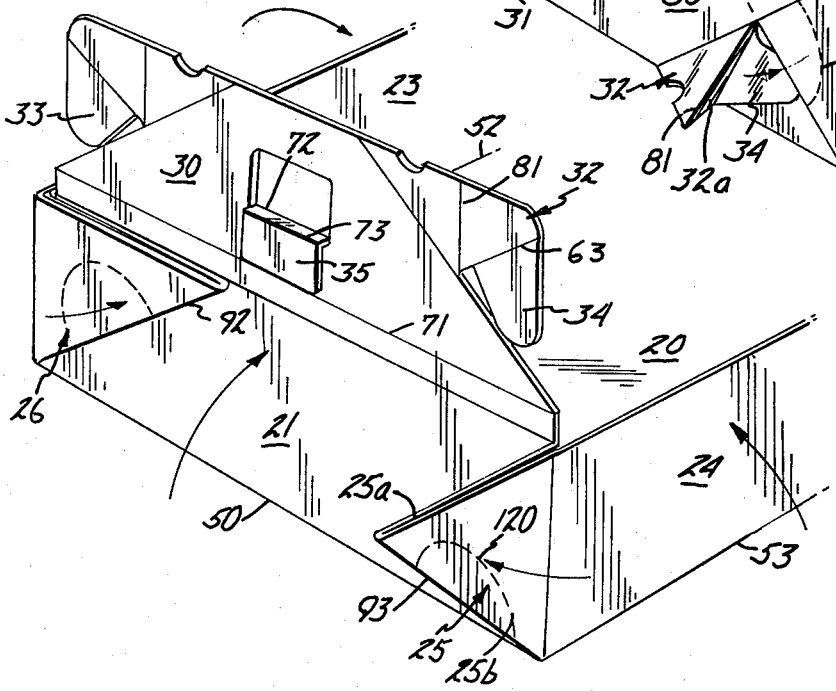

When the same procedure is accomplished at the other three corners, the complete container appears as shown in FIG. 5.

It will be readily appreciated that my container can be used with a separate cover of conventional construction, or that if desired my blank may be modified by extending side 23 for example for folding connection to an integral cover.

Numerous characteristics and advantages of my invention have been set forth in the foregoing description, together with details of the structure and function of the invention, and the novel features thereof, are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A container folded from a single blank of corrugated fiberboard comprising:

(a) a bottom;

(b) a side;

(c) an end;

(d) a webbed corner continuous with said bottom, side and end and folded diagonally to overlie said end when said bottom, side and end are mutually orthogonal;

(e) a flap continuous with said end and folded outward and downward to overlie a portion of said corner when folded; and (f) a lock tab continuous with said flap and including a tongue for insertion between said end and a portion of said folded corner not underlying said flap, said lock tab comprising a perforation score extending in the direction of the length of said container, and a pair of converging crease scores mutually intersecting with said perforation score, said perforation and crease scores being constructed and arranged to permit folding of said lock tab in opposite directions to enable said tongue to lie flat against said end during sliding and insertion beneath said portion of said folded end.

2. A container according to claim 1 in which the material is crushed in the area where said bottom, said side, said end and said corner come together.

3. The container defined by claim 1, in which the diagonal fold of said corner is crushed in the area beneath which said tongue is to be inserted, to facilitate the insertion.

4. The container defined by claim 1, in which the fiberboard is crushed in the area where said bottom, said side, said end and said corner come together.

5. The container defined by claim 1, which comprises two of said sides and ends, four of said webbed corners, a flap continuous with each of said ends and two of said lock tabs for each of said flaps, each of said lock tabs having a tongue insertable beneath one of said corners.

6. The container defined by claim 5, wherein the two ends are disposed in longitudinal opposition, and the corrugations of said fiberboard extend longitudinally of the container.

7. The container defined by claim 1, wherein the fiberboard comprises an inner, water-repellent layer.

8. A container folded from a single blank of corrugated fiberboard comprising:

(a) a bottom;

(b) a side;

(c) an end;

(d) a webbed corner continuous with said bottom, side and end and folded diagonally to overlie said end when said bottom, side and end are mutually orthogonal;

(e) a flap continuous with said end and folded outward and downward to overlie a portion of said corner when folded;

(f) a lock tab continuous with said flap and including a tongue for insertion between said end and a portion of said folded corner not underlying said flap, said lock tab including scores for folds in opposite directions to enable said tongue to lie flat against said end during sliding and pivotal insertion beneath said portion of said folded end; and (g) the diagonal fold of said corner being crushed in the area beneath which said tongue is to be inserted, to facilitate the insertion.

* * * * *